US005231999A

United States Patent [19]

Schroettner

[11] Patent Number: 5,231,999

[45] Date of Patent: Aug. 3, 1993

[54] COMB AND METHOD FOR SEPARATING STRANDS OF HAIR

[76] Inventor: Rudolph J. Schroettner, 4 Pine Ridgeway, Mill Valley, Calif. 94941

[21] Appl. No.: 825,373

[22] Filed: Jan. 24, 1992

[51] Int. Cl.[5] ..... A45D 24/04

[52] U.S. Cl. ..... 132/137; 132/161; 132/150

[58] Field of Search ..... 132/126, 127, 128, 129, 132/137, 140, 141, 142, 150, 152, 159, 160, 161

[56] References Cited

U.S. PATENT DOCUMENTS

| | | | |
|---|---|---|---|
| 1,780,206 | 11/1930 | McKellar | 132/160 |
| 1,841,751 | 1/1932 | McBride | 132/149 |
| 1,994,505 | 3/1935 | Dove | 132/137 |
| 2,216,355 | 10/1940 | Pollock | 132/160 |
| 2,664,092 | 12/1953 | Benco | 132/142 |
| 2,915,071 | 12/1959 | Watkins | 132/150 |
| 3,444,866 | 5/1969 | Battaglia | 132/126 |
| 3,552,403 | 1/1971 | Sestito | 132/150 |
| 4,815,484 | 3/1989 | Stevenson | 132/137 |
| 4,993,438 | 2/1991 | Hunt | 132/208 |
| 4,996,996 | 3/1991 | Hirsh | 132/160 |
| 5,018,542 | 5/1991 | Lee | 132/150 |

FOREIGN PATENT DOCUMENTS

| | | | |
|---|---|---|---|
| 468743 | 10/1950 | Canada | 132/142 |

*Primary Examiner*—John J. Wilson
*Assistant Examiner*—Frank A. LaViola
*Attorney, Agent, or Firm*—Ernest M. Anderson

[57] ABSTRACT

A comb for separating strands of hair to implement and facilitate highlighting, streaking or frosting is described. The comb comprises first and second rows of teeth which project angularly from a handle portion. The teeth in the first row are spaced to initially part and separate strands of hair during combing. The teeth in the second row are adjacent to the first row or teeth but in staggered relation thereto. The teeth in the second row are also shorter in length than the first row of teeth and tapered to provide a secondary partition and separation of strands confined between adjacent teeth of the first row. Each tooth in the second row is also formed with a hook that projects toward an adjacent tooth for engaging and separating alternate strands of hair from a grouping.

10 Claims, 2 Drawing Sheets

COMB AND METHOD FOR SEPARATING STRANDS OF HAIR

BACKGROUND OF THE INVENTION

This invention relates generally to combs and to methods for separating strands of hair to implement and facilitate high-lighting, streaking or frosting. The prior art includes numerous comb designs and construction for separating strands of hair, as well as for holding hair in place, and typically such combs comprise a plurality of teeth which may be tapered or formed with barbs, as disclosed in U.S. Pat. No. 2,915,071.

SUMMARY OF THE INVENTION

The comb construction of the present invention comprises a handle portion from which is mounted first and second rows of teeth. The first row of teeth is spaced to part and separate strands of hair from the underside. A second row of teeth is provided adjacent to the first row but in staggered relation thereto, said second row of teeth being shorter in length than the first row and having tapered surfaces that provide a secondary partition and separation of strands that pass between adjacent teeth in the first row. Each of the second row of teeth is also formed with a hook that projects toward an adjacent tooth of the second row for engaging and retaining alternate strands of hair for further separation.

The comb construction of this invention may be used in a novel process for highlighting, streaking or frosting hair. In general, the process comprises the steps of engaging a group of hairs, separating said group of hairs into a first series of strands, separating said first series of strands into second and third series of strands which are alternately separated but interspersed with the strands of the other in the group. The second series of strands are then pulled free from the group, separating them from interspersion with the third series which are then supported upon a palette for highlighting, streaking or frosting.

A primary object of the present invention is to provide a comb to facilitate and enhance the highlighting, streaking or frosting of hair.

A second object is to provide a comb which may be used by persons having little expertise in the highlighting, streaking or frosting of hair to accomplish professional results.

A still further purpose and object of the invention is to provide a comb which separates the hairs of a grouping in two stages to enhance separation of one series of strands from another and to provide uniformity in separation.

DESCRIPTION OF THE DRAWINGS

In the drawings, forming a part of the application and in which like parts are identified by like reference numerals throughout the same.

Referring to FIG. 1, there is shown a preferred embodiment of the invention in a comb 10 that is designed to implement and facilitate highlighting, streaking or frosting of hair. The comb in general comprises a palette 11 that is part of a handle 12. A first row of teeth 13 projects angularly from one edge of the palette. The teeth of the first row are spaced to part and separate strands of hair during combing, as shown in FIG. 2. A second row of teeth 14 also project angularly from the palette, the second row of teeth being adjacent to the first row but in staggered relation thereto. The teeth of the second row are shorter in length than those in the first row and are tapered outward and downward. The second row of teeth provides a secondary separation of strands which pass between adjacent teeth of the first row. The teeth of the second row are also formed with a hook, best shown in FIG. 5, each hook projecting toward an adjacent tooth of the second row for engaging and retaining the alternate strands of secondary separation. It will be further noted that the second row of teeth 14 are preferably offset behind the first row of teeth, as shown in FIGS. 7A and 7B. This offset provides a spacing between teeth of the first and second rows, allowing strands of hair to pass downwardly between the teeth and become engaged by the hooks.

Figure 7A:
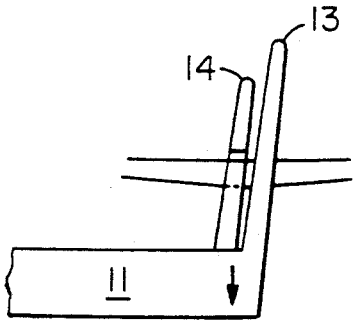
FIGS. 7A and 7B are side views illustrating the process of separation as the comb is moved downwardly.
Figure 6:
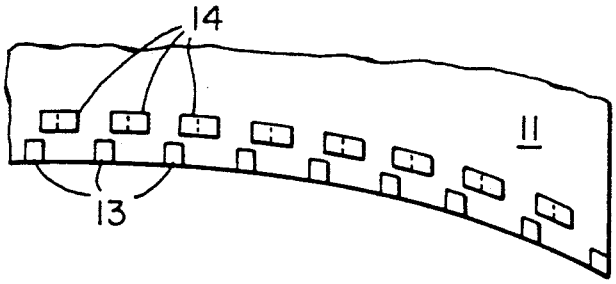
FIG. 6 is a plan view of the teeth.
Figure 7B:
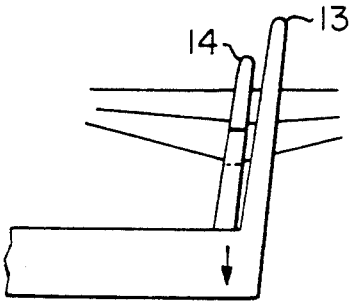
Figure 5:
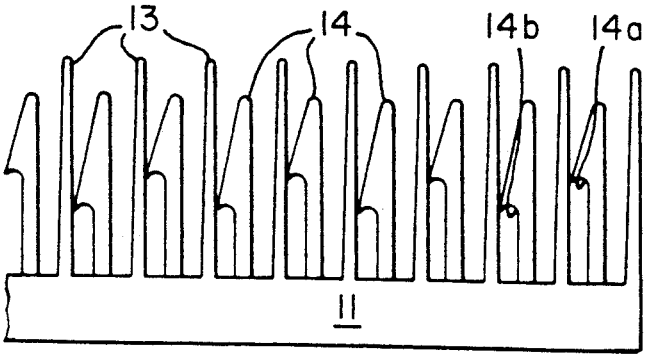
FIG. 5 is an elevational view of the teeth of the comb.
Figure 8:
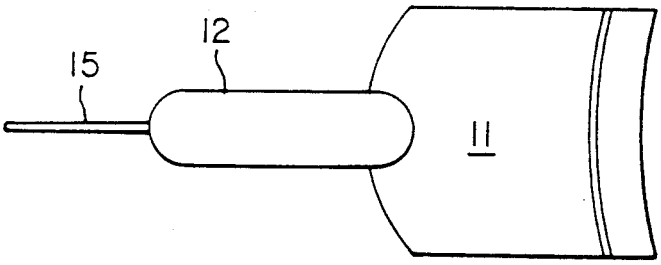
FIG. 8 illustrates the backside or underside of the comb.

The second row of teeth 14 is preferably formed with hooks at two different distances, as shown in FIG. 5. The hook portion 14*a* is provided on alternate teeth of the second row, the remaining teeth being formed with a lower hook surface 14*b* that is closer to the surface of the palette. Thus, in the process of separation, as shown in FIGS. 7A and 7B, and as the comb is moved downwardly, the lowermost hooks 14*b* engage strands sooner than those engaged by the hooks 14*a*. This construction lessens the amount of force required to effect a parting and separation of strands and has been found preferable to hook surfaces which engage hair strands simultaneously.

The preferred embodiment of the invention also provides a rattail 15 that extends from handle 12. Rattails are, of course, a common feature of many combs and is not itself novel. However, the use of a rattail provides a certain further utility to the comb for parting and isolating groups of hair strands.

Figure 9:
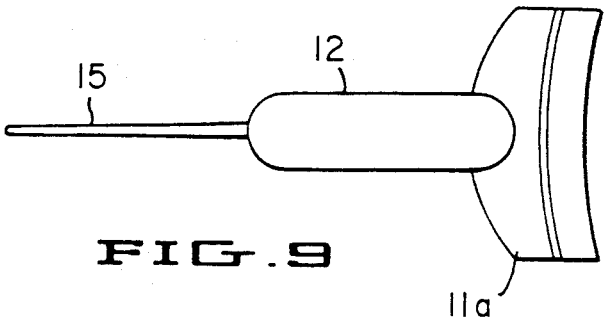
FIG. 9 illustrates a second embodiment of a comb having a smaller palette.

FIG. 9 illustrates a modified form of the invention in a comb having a palette 11*a* of much shorter dimension than the palette 11. The size of the palette is selected based on the need and intended use of the comb. A larger palette surface is provided for supporting the hair strands during the actual highlighting or streaking of the hair. The comb construction of FIG. 9 is preferable when the separated hair strands are supported upon foil as is a common practice to highlighting, streaking or frosting hair.

Figure 10:
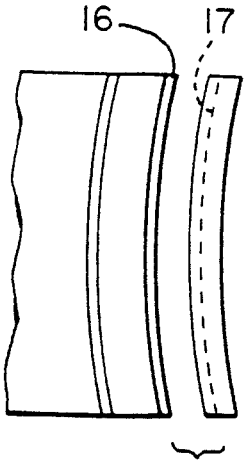
FIGS. 10 and 11 illustrate a comb construction where the teeth of the comb are provided as a separate unit from the palette or handle to which it may be disconnectably engaged.
Figure 11:
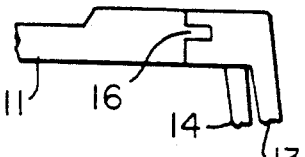

FIGS. 10 and 11 illustrate a further embodiment in a comb construction that features means for disconnectably engaging the tooth portion of the comb from the handle. The handle is formed with an elongated wedge 16 and the teeth 13 and 14 are formed as a separate unit having an elongated slot 17 that receives the wedge for disconnectable attachment. This construction allows the handle to be utilized with different arrangements, sizes, shapes and spacing of teeth.

Figure 1:
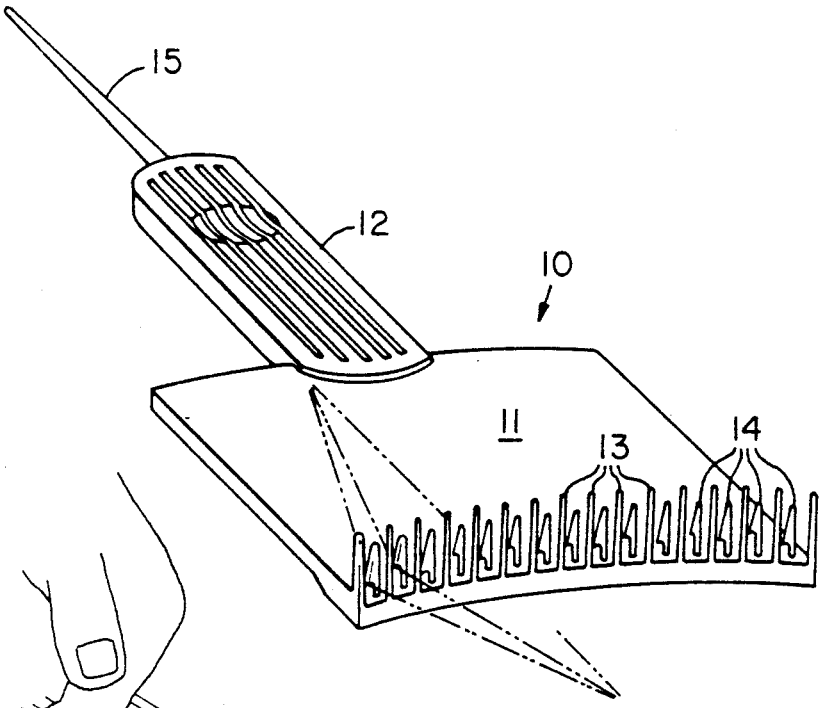
FIG. 1 is a perspective view of a preferred embodiment of a comb for use in highlighting, streaking or frosting hair.
Figure 2:
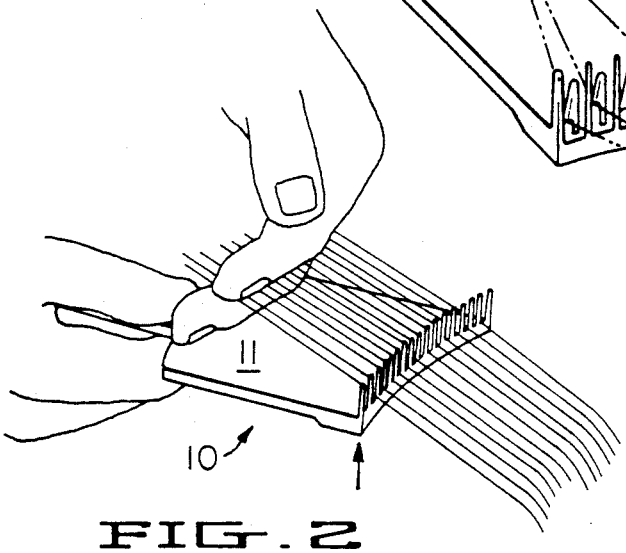
FIGS. 2, 3 and 4 illustrate the manner in which the comb is utilized to separate the strands of hair from others.
Figure 3:
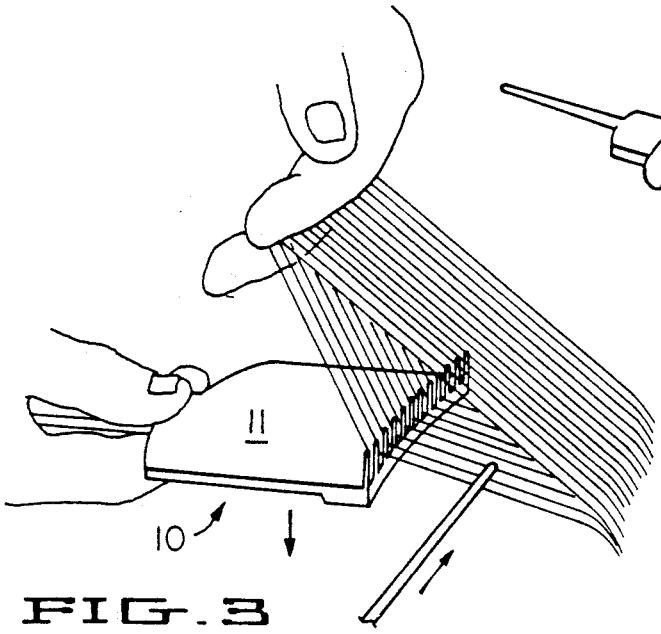
Figure 4:
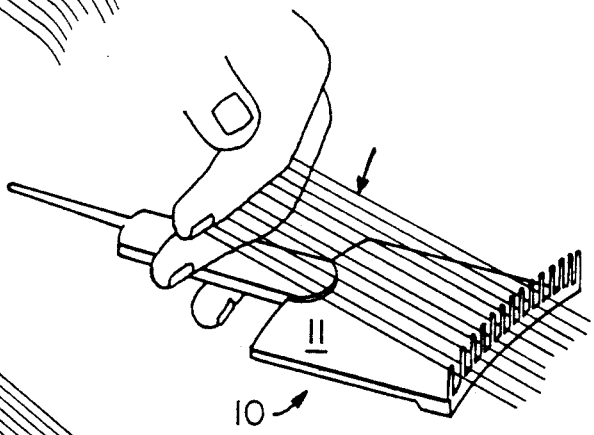

In operation, comb 10 is used as shown in FIGS. 2–4. A grouping of hairs is grasped between the middle and index fingers of one hand. Comb 10 is then placed beneath the grouping of hairs with teeth 13 and 14 pointed upwardly. The hairs may be combed several times from the underside of the grouping before alternate strands of hair are separated from the others which is accomplished by moving the comb downwardly, as shown in FIG. 3. It will be apparent that those strands of hair caught up by the hooks 14*a* and 14*b* are effectively separated from the other strands of hair which remain in the grasp of the two fingers. The rattail 15 may be used to facilitate or maintain a separation of the strands, those which are engaged by the hook portions being pulled from the group of the two fingers and released. The palette portion of the comb may then be positioned beneath those strands which remain engaged by the fingers. The hair strands are then supported on the palette, as shown in FIG. 4, for painting or tinting in the customary manner.

Although a preferred embodiment has been illustrated and described, various modifications and changes may be resorted to without departing from the spirit of the invention or the scope of the appended claims, and each of such modifications and changes is contemplated.

What is claimed is:

1. A comb for separating strands of hair to implement and facilitate highlighting, streaking or frosting, comprising: a handle portion; a first row of teeth projecting angularly from said handle portion, said first row of teeth being spaced to part and separate strands of hair during combing; and a second row of teeth projecting angularly from said handle portion, said second row of teeth being adjacent to said first row of teeth and in staggered relation thereto, said second row of teeth being shorter in length than said first row of teeth and having a tapered surface that provides a secondary partition and separation of strands passing between adjacent teeth in said first row, each of said second row of teeth also being formed with a hook that projects toward an adjacent tooth of said second row for engaging and retaining the alternate strands after secondary separation.

2. The comb of claim 1, said second row of teeth being offset from said first row of teeth.

3. The comb of claim 1, said second row of teeth comprising teeth formed with hooks at two different distances from the ends, the teeth formed with hooks at one distance from the ends being spaced in said second row between teeth formed with hooks at a second distance from the ends, whereby strands of hair engaged by hooks formed at the one distance will engage strands of hair sooner than hooks formed at the second distance.

4. The comb of claims 1, 2 or 3, said first and second rows of teeth being arcuate in shape to conform generally with the curvature of the human skull.

5. The comb of claims 1, 2 or 3, said handle portion comprising a palette from which said first and second rows project, and a rattail for parting the hair prior to combing and separating.

6. The comb of claims 1, 2 or 3, said first and second rows of teeth being integrally formed as unit, and means disconnectably engaging the unit from said handle portion.

7. The comb of claims 1, 2 or 3, said handle portion being formed with an elongated wedge, said first and second rows of teeth being formed as a unit, said unit being integrally formed with an elongated slot that receives said wedge for disconnectable attachment.

8. A process for high-lighting, streaking or frosting hair and comprising the steps: engaging a group of hairs, separating said group of hairs into a first series of strands, separating said first series of strands into second and third series of strands, said second and third series being alternately separated but interspersed, pulling the strands of said second series free from the group and separating them from interspersion with said third series, and then supporting said third series upon a palette for highlighting, streaking or frosting, said first and second series of interspersed hairs being supported in a common plane, said second series of strands being pulled downwardly while said third series remain supported until the second series of strands are no longer supported, thereby separating the second strands from said third strands.

9. The process of claim 8, said second series of strands being pulled downwardly and separated from said first series in two stages of separation, alternate groupings of strands in said second series being pulled and separated sooner than other strands of said second series.

10. A process for highlighting, streaking or frosting hair and comprising the steps: engaging a group of hairs, separating said group of hairs into a first series of strands, separating said first series of strands into second and third series of strands, said second and third series being alternately separated but interspersed, pulling the strands of said second series free from the group and separating them from interspersion with said third series, and then supporting said third series upon a palette for highlighting, streaking or frosting, said second series of strands being pulled downwardly and separated from said first series in two stages of separation, alternate groupings of strands in said second series being pulled and separated sooner than other strands of said second series.

* * * * *